US005493276A

United States Patent [19]

Alvira

[11] Patent Number: 5,493,276

[45] Date of Patent: Feb. 20, 1996

[54] FATIGUE ALARM

[76] Inventor: Ramon I. Alvira, Ur 6 Rea Ramos Antonini 116 #4 St., San Lorenzo, Puerto Rico, 00754

[21] Appl. No.: 297,212

[22] Filed: Aug. 29, 1994

[51] Int. Cl.[6] ..... G08B 23/00

[52] U.S. Cl. ..... 340/576; 340/575; 340/573

[58] Field of Search ..... 340/576, 575, 340/573; 180/272

[56] References Cited

U.S. PATENT DOCUMENTS

| | | | |
|---|---|---|---|
| 3,409,101 | 11/1968 | Williams | 340/576 |
| 3,946,288 | 3/1976 | Isaksson et al. | 340/576 |
| 4,485,375 | 11/1984 | Hershberger | 340/576 |
| 4,540,979 | 9/1985 | Gerger et al. | 340/576 |
| 4,617,559 | 10/1986 | Slansky | 340/576 |
| 4,706,072 | 11/1987 | Ikeyama | 340/576 |
| 5,170,525 | 12/1992 | Cafaro | 15/28 |

*Primary Examiner*—John K. Peng
*Assistant Examiner*—Benjamin C. Lee

[57] ABSTRACT

A fatigue alarm comprising a housing, with the housing including a first fixed handle plate extending from the housing and a second movable handle plate separated from the first handle plate in a biased separation relative to one another, such that a first electrical contact secured to the second handle plate within the housing is in contiguous communication with a second electrical contact within the housing in a normal configuration, such that upon separation of the first electrical contact relative to the second electrical contact against a spreader member within the housing effects disengagement and de-actuation of an audible alarm, whereupon fatigue permits movement of the second handle plate away from the first handle plate to engage the first electrical contact and the second electrical contact to actuate the audible alarm to alert an individual relative to onset of sleep.

1 Claim, 4 Drawing Sheets

FATIGUE ALARM

TECHNICAL FIELD

The field of invention relates to alarm structure, and more particularly pertains to a new and improved fatigue alarm such that relaxation of a grip thereon effects actuation of an audible alarm to assist an individual in preventing undesired sleep particularly in operation of a motor vehicle.

BACKGROUND OF THE INVENTION

Various prior art devices have been employed to assist drivers and the like in preventing sleep such as U.S. Pat. Nos. 4,259,665; 3,863,245; 4,059,830, and 4,875,030.

The instant invention attempts to overcome deficiencies of the prior art by utilizing spaced handles arranged in a biased separating relationship, such that squeezing of the handles prevents actuation of the alarm and to this end, the instant invention addresses this need.

SUMMARY OF THE INVENTION

To attain this, the fatigue alarm of the invention employs a housing such that spaced handles biased in a separating relationship relative to one another effects closure of contact points, such that grasping of the handle separates the contact points, whereupon the onset of sleep engages the contacts to actuate an audible alarm to assist an individual in preventing sleep.

Objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms therefore, specific structural and functional details disclosed herein are not to be interpreted as limiting, but merely as a basis for the claims and as a representative basis for teaching one skilled in the art to variously employ the present invention in virtually any appropriately detailed structure.

Figure 6:
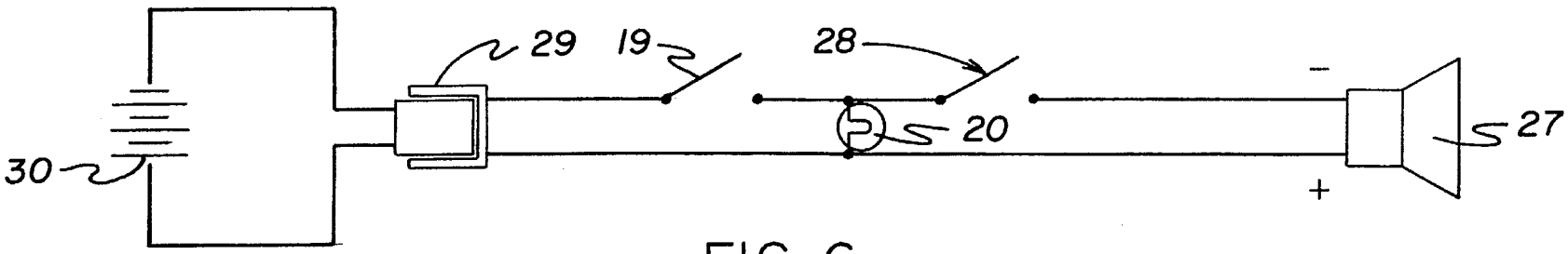
FIG. 6 is a diagrammatic electrical illustration of the cooperative nature of the circuitry employed by the invention.
Figure 8:
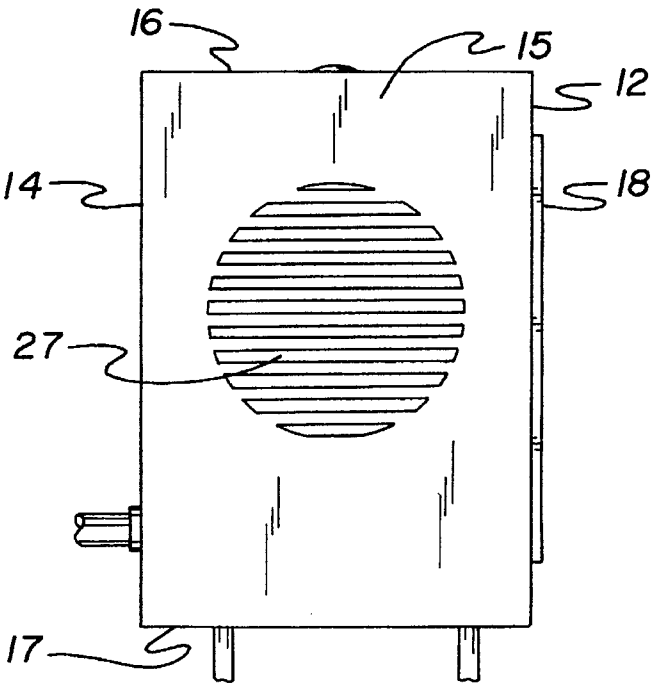
FIG. 8 is an orthographic view of the speaker wall structure of the housing of the invention.
Figure 7:
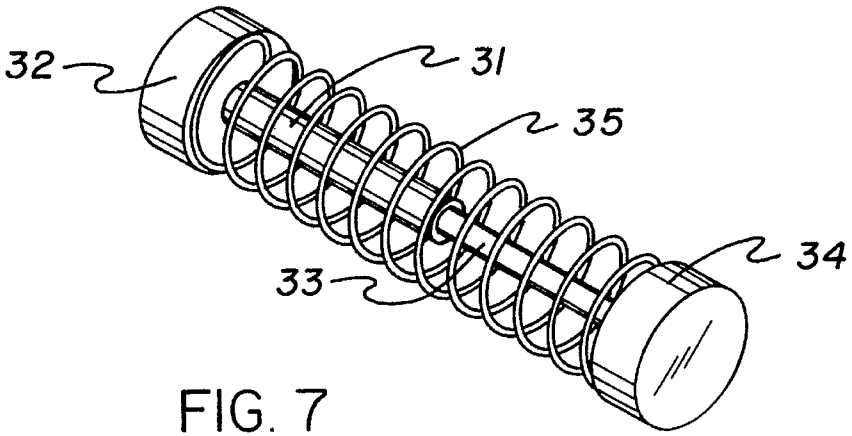
FIG. 7 is an isometric illustration of the spreader member employed by the invention.

The fatigue alarm 10 of the invention employs a housing 11 defined by a first wall 12, a second wall 13, a spaced third wall 14, and a fourth wall 15, as well as a top wall 16 spaced from a bottom wall 17 to define a housing cavity 23 within the housing 11. A magnet 18 is fixedly secured to an exterior surface of the first wall 12 to permit selective securement of the device during periods of non-use within a vehicular cab onto a ferrous metallic surface (not shown) that are commonly found in vehicle passenger compartments. A first switch 19 of an on/off type is directed through the second end wall 13, while an audio speaker 27 is mounted within the cavity 23 to the fourth wall 15 for audible projection through openings within the fourth wall. An electrical supply cable 36 is directed into the housing for electrical communication with a battery 30, wherein the electrical supply cable 36 may employ a cigarette lighter plug connector or any other type of electrical connection structure 29 for electrical communication of circuitry of the organization relative to a battery 30. With the connection of the on/off first switch 19, illumination member 20 is illuminated that is mounted below the on/off first switch 19 on the second wall 13, in a manner as indicated in FIG. 6. A first handle plate 21 projects through the bottom wall 17 and is fixedly secured within the housing 11 within the cavity 23 to the first wall 12, while a second handle plate 22 is arranged in biased, spreading relationship relative to the first handle plate 21 and is secured relative to the first handle plate 21 through a connecting web 24 that in turn is secured to the top wall 16 within the housing cavity 23. It should be noted that projection of the first and second handle plates 21 and 22 are covered by respective first and second insulation portions 21*a* and 22*a* to isolate an individual grasping the first and second handle plates 21 and 22.

First electrical contact 25 is secured to the second handle plate 22 in a facing relationship relative to a second electrical contact 26, that in turn is secured to the third wall 14 to define a second switch 28, such as indicated in FIG. 6, such that manual grasping of the first and second handle plates 21 and 22 by the respective first and second insulative portions 21*a* and 22*a* separates the first and second electrical contact 25 and 26 respectively to prevent actuation of the audio speaker 27. It should be noted that the audio speaker 27 has its own amplifier drive in a self-contained integrated unit for compactness of construction indicated by the numeral 27.

The spreader member contained within the housing to effect mechanical separation of the first and second handle plates within the housing cavity 23 is provided to bias the first and second electrical contacts in communication relative to one another. To this end, the spreader member employs a tube head 32 mounting a tube 31 that in turn receives a rod 33 slidably therewithin, whereas the rod 33 includes a rod head 34 fixedly secured to the first handle plate 21 within the cavity 23, with a spring member 35 in a surrounding relationship relative to the tube 31 and the rod 33 captured between the tube head 32 and the rod head 34.

Figure 1:
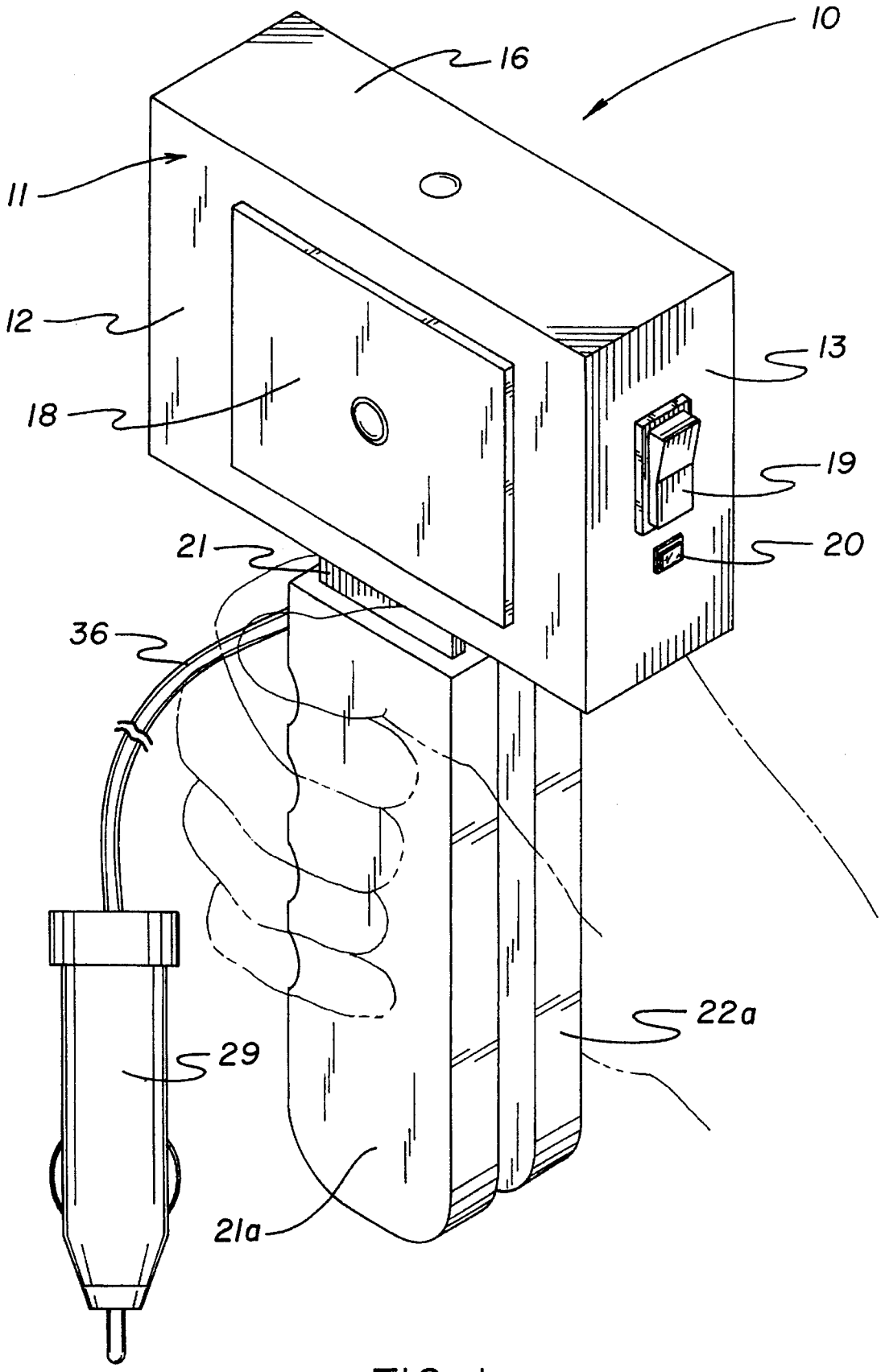
FIG. 1 is an isometric illustration of the invention.
Figure 2:
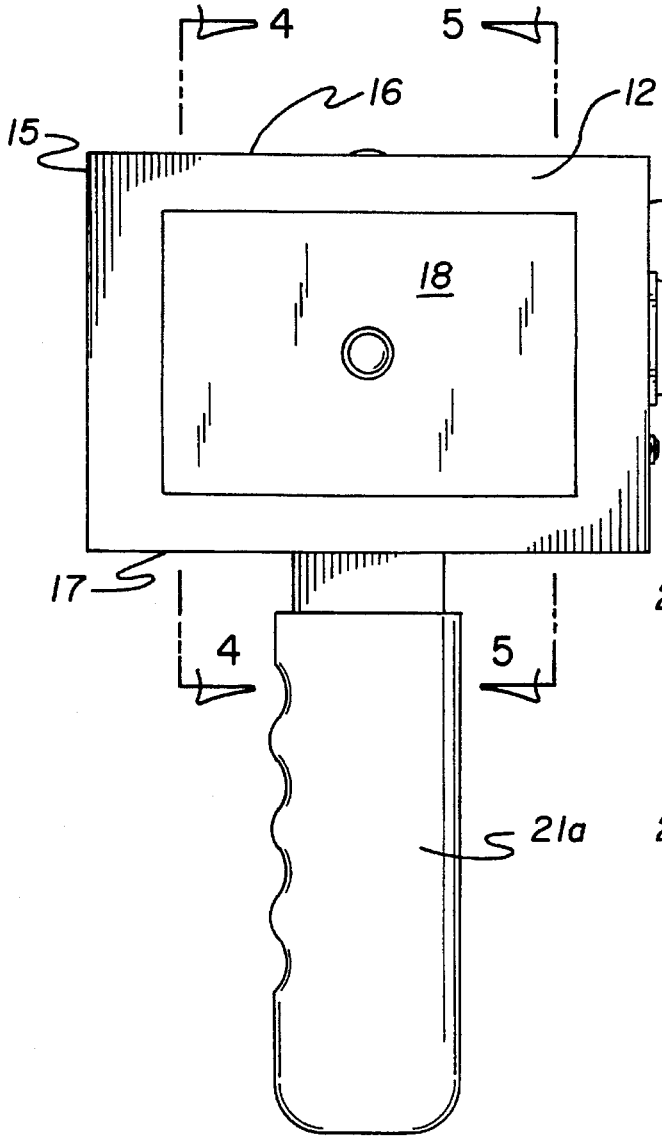
FIG. 2 is an orthographic frontal view of the invention.
Figure 3:
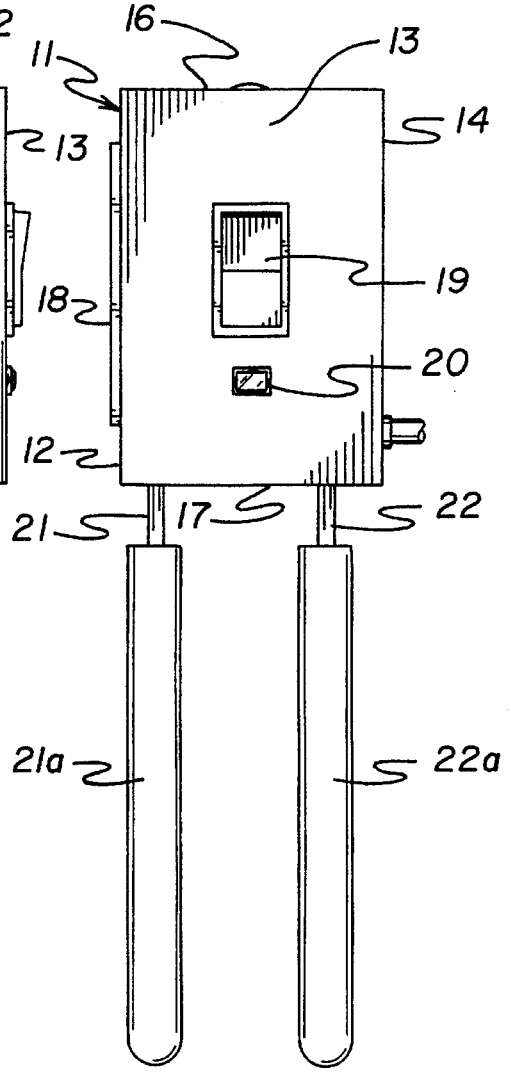
FIG. 3 is an orthographic end view of the invention.
Figure 4:
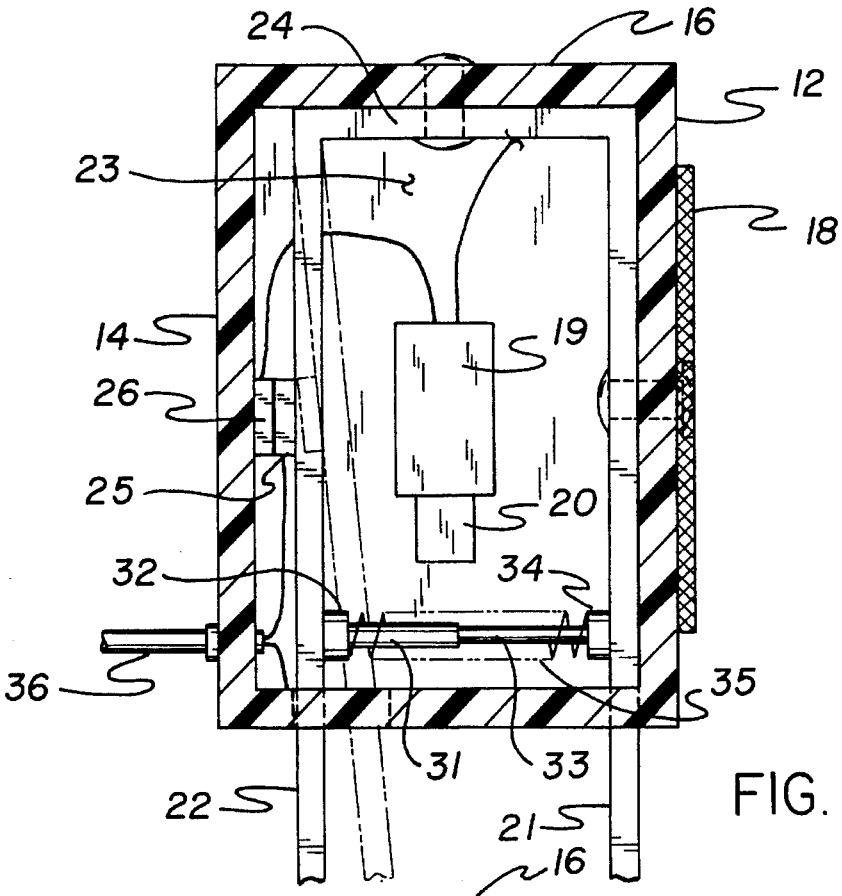
FIG. 4 is an orthographic view, taken along the lines 4—4 of FIG. 2 in the direction indicated by the arrows.
Figure 5:
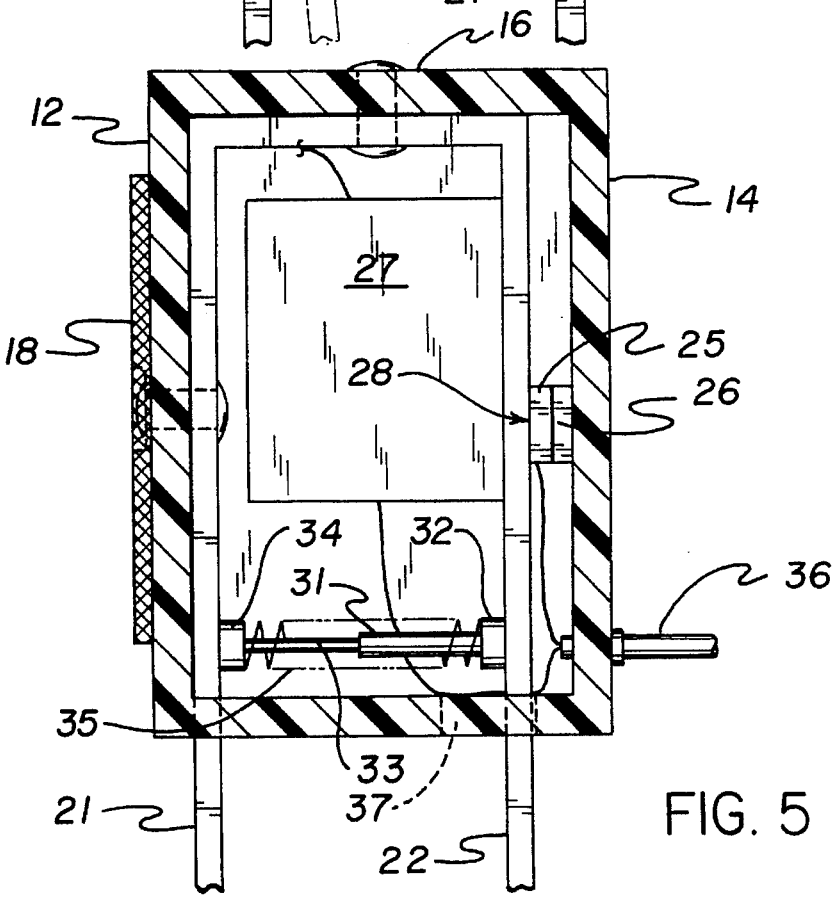
FIG. 5 is an orthographic view, taken along the lines 5—5 of FIG. 2 in the direction indicated by the arrows.

It should be noted that the bottom wall, as illustrated in FIG. 5, includes a slot 37 to receive the second handle plate 22 therethrough to permit pivoted movement of the second handle plate through the bottom wall permitting separation of the first electrical contact 25 relative to the second electrical contact 26.

It is to be understood that while certain forms of the present invention have been illustrated and described herein, it is not to be limited to the specific forms or arrangement of parts described and shown.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed and desired to be protected by LETTERS PATENT of the United States is as follows:

1. A fatigue alarm, comprising, a housing, the housing having a top wall spaced from a bottom wall, and a surrounding wall directed coextensively between the top wall and the bottom wall to define a housing cavity within the housing, and a first handle plate fixedly mounted to the housing, and a second handle plate received through a slot in the bottom wall permitting movement of the second handle plate through the bottom wall, and a spreader member positioned within the housing cavity and extending between and secured to the first handle plate and the second handle plate and arranged to bias the first handle plate and the second handle plate in a spaced relationship relative to one another, and a first electrical contact secured to the second handle plate, and a second electrical contact secured to the surrounding wall within the cavity, such that said spreader member effects biased separation of the first handle plate relative to the second handle plate to direct contiguous communication of the first electrical contact with the second electrical contact, and an audio alarm device mounted within the cavity in electrical communication to the first electrical contact and the second electrical contact, whereupon communication of the first electrical contact to the second electrical contact is arranged to effect actuation of the audio alarm;

said spreader member including a tube head secured to the second handle plate and a rod head secured to the first handle plate, with a rod secured to the rod head and a tube secured to the tube head, with the rod reciprocatably directed through the tube and a spring member captured between the tube head and the rod head to bias the first handle plate in a spaced relationship relative to the second handle plate to effect contiguous communication of the first electrical contact and the second electrical contact.

* * * * *